US006255937B1

(12) United States Patent
Hamaguchi

(10) Patent No.: US 6,255,937 B1
(45) Date of Patent: Jul. 3, 2001

(54) NOTIFYING DEVICE USING ALTERNATING DRIVE SIGNALS

(75) Inventor: Toshihide Hamaguchi, Higashiosaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/446,267

(22) PCT Filed: Jun. 11, 1998

(86) PCT No.: PCT/JP98/02601

§ 371 Date: Dec. 20, 1999

§ 102(e) Date: Dec. 20, 1999

(87) PCT Pub. No.: WO98/57761

PCT Pub. Date: Dec. 23, 1998

(30) Foreign Application Priority Data

Jun. 18, 1997 (JP) ..... 9-161044

(51) Int. Cl.[7] ..... G08B 3/10

(52) U.S. Cl. ..... 340/384.7; 340/384.72

(58) Field of Search ..... 340/384.7, 384.71, 340/384.72, 407.1, 692, 311.1, 825, 46, 825.44

(56) References Cited

U.S. PATENT DOCUMENTS 3,579,233 * 5/1971 Raschke ..... 340/384 E
4,626,799 * 12/1986 Matievic ..... 340/384 E
4,631,517 * 12/1986 Ajland ..... 340/384 E
5,675,312 * 10/1997 Burnett ..... 340/384.72
5,939,992 * 8/1999 Devries et al. ..... 340/384.72

FOREIGN PATENT DOCUMENTS 58-218296 12/1983 (JP) .
9-70571 3/1997 (JP) .

* cited by examiner

*Primary Examiner*—Daniel J. Wu
*Assistant Examiner*—John Tweel, Jr.
(74) *Attorney, Agent, or Firm*—Armstrong, Westerman, Hattori, McLeland & Naughton LLP

(57) ABSTRACT

A notifying device adapted to give notification with both sound and vibration includes a notifying unit 2 which comprises a first vibrator drivable at an audio-frequency with a first drive signal for producing sound waves, and a second vibrator drivable with a second drive signal at a frequency, up to several hundred of hertz, lower than the driving frequency of the first vibrator for producing a perceivable vibration. A notifying signal generating circuit 5 is connected to the unit 2 via a switch 59. The circuit 5 comprises a sound signal generating circuit 57 for producing an intermittent first signal repeating on and off states with a predetermined period, a vibration signal generating circuit 58 for producing an intermittent second signal repeating on and off states with the same period as the first drive signal, and a synchronization circuit 56 for causing the respective circuits 57, 58 to produce the first drive signal and the second drive signal without any overlap between the on periods of these signals. This construction obviates marked increases in the power consumption of the device.

5 Claims, 4 Drawing Sheets

NOTIFYING DEVICE USING ALTERNATING DRIVE SIGNALS

TECHNICAL FIELD

The present invention relates to notifying devices for use in portable telephones, pagers or like portable communications devices, or in wristwatches, toys or like small devices.

BACKGROUND ART

Conventional portable telephones (cellular phones) have incorporated therein a sound generator (ringer) for notifying the user of incoming calls with sound and a vibration generator for notifying the user of incoming calls. One of the two generators is selectively usable according to the situation.

However, small devices such as portable telephones have little or no excessive space for accommodating both the sound generator and the vibration generator, and therefore encounter the problem of becoming greater in size if equipped with the two generators.

Accordingly, the present applicant has already proposed a compact notifying unit 2 having the functions of a sound generator and a vibration generator as shown in FIG. 2 (Japanese Patent Application No. 161399/1996).

The notifying unit 2 comprises, as housed in a common casing 21, a first vibrator 4 for producing chiefly sound, and a second vibrator 3 for producing chiefly vibration as illustrated. The casing 21 comprises a hollow cylindrical body 22, an annular front cover member 24 having a sound release aperture 25 and attached to an open front side of the body 22, and an annular rear cover member 23 attached to an open rear side of the body 22.

The first vibrator 4 comprises a circular first diaphragm 41 having its peripheral portion held between the casing body 22 and the front cover member 24, and a coil 42 fixed to the rear side of the first diaphragm 41. The first vibrator 4 has a resonance frequency in the audible range.

On the other hand, the second vibrator 3 comprises an annular second diaphragm 34 having its peripheral portion held between the casing body 22 and the rear cover member 23, an outer yoke 32 secured to the inner peripheral portion of the second diaphragm 34, a permanent magnet 31 fixed to the front side of the outer yoke 32, and an inner yoke 33 fixed to the front side of the magnet 31. The coil 42 of the first vibrator 4 is accommodated in an annular magnetic gap defined by opposed faces of the outer yoke 32 and the inner yoke 33. The second vibrator 3 has a low resonance frequency actually inaudible.

FIG. 5 shows the construction of the main circuit of a portable telephone having the notifying unit 2 described. The telephone is so adapted that when pressed, a manual button 14 enables the user to select notification with sound, notification with vibration or notification by simultaneous operation of both the sound and vibration means for alerting the user to incoming calls. According to the selection thus made, an alert setting circuit 55 sets the selected alerting method for the control circuit 54.

The main circuit comprises a sound signal generating circuit 61 for producing a sound drive signal a of audio-frequency (e.g., about 2 kHz) for notification with sound, a vibration signal generating circuit 62 for producing a vibration drive signal b of actually inaudible low frequency (e.g., about 100 Hz) for notification with vibration, and an adder 63 for adding together the two drive signals delivered from the respective circuits 61, 62 to prepare a combined drive signal a+b for notification with both sound and vibration. One of these three drive signals is selected by a switch 6 and fed to the notifying unit 2. The switch 6 is controlled by the control circuit 54 for a change-over.

As shown in FIGS. 6, (*a*) and (*b*), the sound drive signal a and the vibration drive signal b are each an intermittent signal involving repetition of on-state and off-state with a predetermined period (e.g., about 3 seconds) to give effective notification.

Radio waves transmitted by the base station are received by an antenna 1 shown in FIG. 5 at all times with a specified period. The signal received is frequency-converted and demodulated by a radio circuit 51 and then fed to a signal processing circuit 52, which extracts a digital sound signal and a control signal from the signal. The operation of the signal processing circuit 52 is controlled by the control circuit 54.

The control signal obtained from the signal processing circuit 52 is fed to an incoming call detecting circuit 53, whereby an incoming call is detected if any. On the other hand, the sound signal given by the circuit 52 is fed to an unillustrated sound signal processing circuit and then output from a speaker as sound.

When an incoming call is detected by the circuit 53, the control circuit 54 changes over the switch 6 in conformity with the alert setting by the manual button 14 to feed the sound drive signal a, vibration drive signal b or combined drive signal a+b to the notifying unit 2.

When the sound drive signal a is fed to the coil 42 of the notifying unit 2, the first vibrator 4 resonates, producing sound waves mainly, whereas when the vibration drive signal b is fed to the coil 42 of the notifying unit 2, the second vibrator 3 resonates to produce vibration mainly.

Alternatively when the combined drive signal a+b is selected, the first vibrator 4 and the second vibrator 3 operate, producing sound waves and vibration at the same time.

With small portable devices such as portable telephones, the capacity of the cell serving as the power source is limited. Especially in the case of the portable telephone, other circuits including the ratio circuit start to operate at the same time upon receiving an incoming call, so that the limitation involved is severe.

The portable telephone shown in FIG. 5 is adapted to prepare the combined drive signal a+b by adding the sound drive signal a and the vibration drive signal b together to cause the notifying unit 2 to produce both sound waves and vibration. At this time, the on period of the sound drive signal a and that of the vibration drive signal b are likely to overlap as shown in FIGS. 6, (*a*) and (*b*), so that the powder consumption increases markedly during the overlapping period as shown in FIGS. 6, (*c*).

Consequently, the power consumption exceeds the capacity of the cell, entailing the problem of interrupting the incoming call or conversation or causing trouble to other circuits.

An object of the present invention is to preclude marked increases in the power consumption of a notifying device which is adapted to give notification with both sound and vibration.

DISCLOSURE OF THE INVENTION

The present invention provides a notifying device which comprises a first vibrator drivable at an audio-frequency with a first drive signal for producing sound waves, a second vibrator drivable with a second drive signal at a frequency lower than the driving frequency of the first vibrator for producing a perceivable vibration, and a signal generating circuit for producing the first drive signal and the second drive signal, the notifying device being characterized in that the on period of the first drive signal for driving the first vibrator and the on period of the second drive signal for driving the second vibrator alternate with a predetermined period.

With the notifying device of the present invention, the on period of the first drive signal for driving the first vibrator and the on period of the second drive signal for driving the second vibrator alternate with a predetermined period and are unlikely to overlap each other.

Accordingly, the power for driving the first vibrator and the power for driving the second vibrator are merely required during different time periods, whereby marked power consumption is avoided.

Stated more specifically, the signal generating circuit comprises a circuit for producing an intermittent first signal repeating on and off states with a predetermined period, a circuit for producing an intermittent second signal repeating on and off states with the same period as the first drive signal, and timing control means for causing the respective circuits to produce the first drive signal and the second drive signal without any overlap between the on periods of these signals.

According to this specific construction, the first drive signal and the second drive signal are produced out of phase, with no overlap between their on periods. Accordingly the on period of the first drive signal for driving the first vibrator alternates with the on period of the second drive signal for driving the second vibrator with a predetermined period.

Further according to the present invention embodied as a notifying device proposed by the present applicant and having the functions of a sound generator and a vibration generator, a first vibrator 4 and a second vibrator 3 are housed in a common casing 21, the first vibrator 4 comprising a coil 42 attached by a first diaphragm 41 to the casing 21, the second vibrator 3 comprising a magnet attached by a second diaphragm 34 to the casing 21, the magnet being formed with a magnetic gap having the coil 42 of the first vibrator 4 accommodated therein.

This embodiment has a signal generating circuit which prepares a combined drive signal comprising a first drive signal and a second drive signal superposed thereon with no overlap between the on periods of the signals and feeds the combined drive signal to the coil 42.

Accordingly, the first vibrator resonates during the on period of the first drive signal to produce sound waves, and the second vibrator resonates during the on period of the second drive signal to produce vibration.

Stated more specifically, the signal generating circuit comprises a circuit for producing an intermittent first signal repeating on and off states with a predetermined period, a circuit for producing an intermittent second signal repeating on and off states with the same period as the first drive signal, timing control means for causing the respective circuits to produce the first drive signal and the second drive signal without any overlap between the on periods of these signals, and signal selecting means for preparing a combined drive signal by alternately selecting the first drive signal and the second drive signal produced by the respective signal generating circuits with the predetermined period.

According to this specific construction, the first drive signal and the second drive signal are produced out of phase, that is, the two signals are made different from each other in on period without any overlapping on period. Further the on periods of the two drive signals are alternately selected with the predetermined period to thereby obtain a combined drive signal wherein the on period of the first drive signal for driving the first vibrator alternates with the on period of the second drive signal for driving the second vibrator with the predetermined period.

The notifying device of the present invention is free of the likelihood that the on period of the first drive signal for driving the first vibrator and the on period of the second drive signal for driving the second vibrator will lap over each other. This obviates marked increases in power consumption, and the operation to give notification with sound and vibration is unlikely to cause trouble to other operation of the device.

BEST MODE OF CARRYING OUT THE INVENTION

A detailed description will be given below of a portable telephone embodying the present invention.

Figure 7:
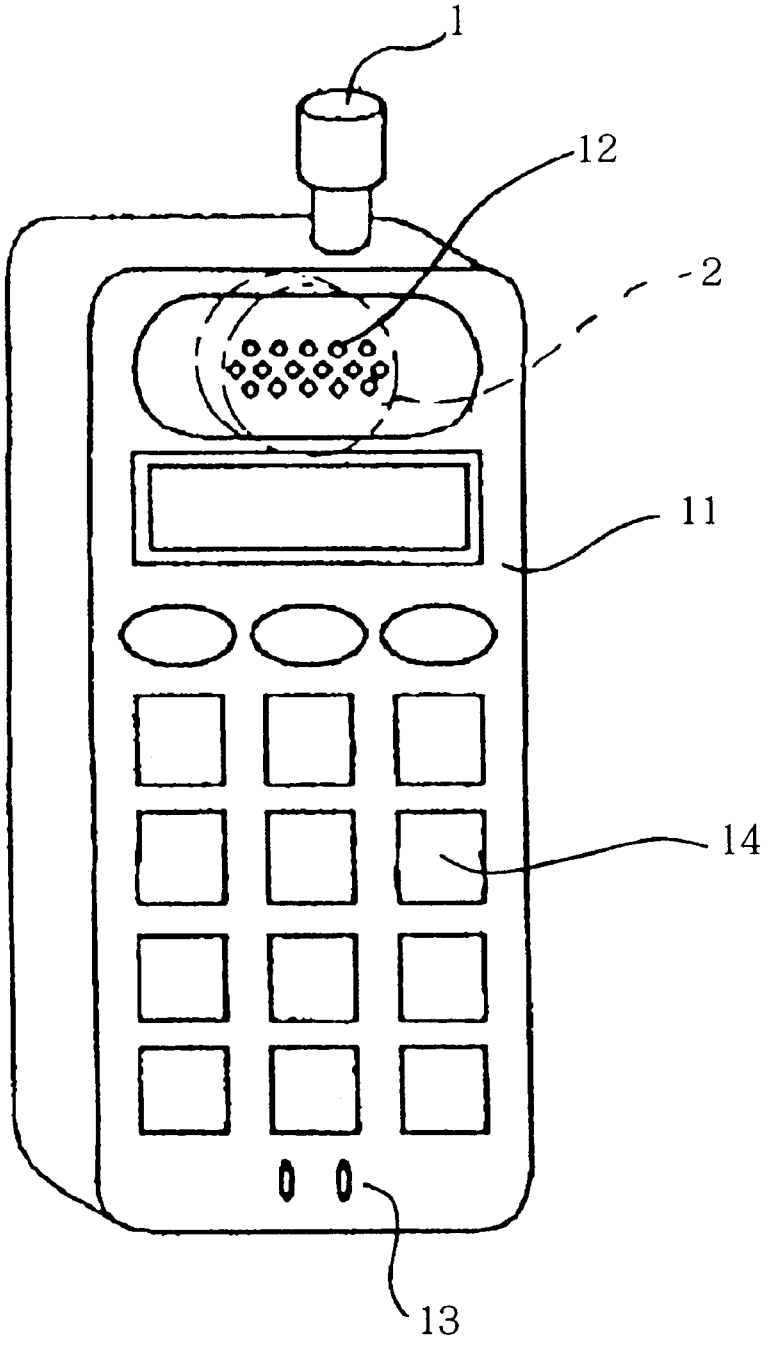
FIG. 7 is a perspective view showing the appearance of a portable telephone.

As shown in FIG. 7, the telephone of the invention comprises a flat case 11 having an antenna 1 and provided on the surface thereof with a speech receiving portion 12 incorporating a speaker, manual buttons 14 such as numerical keys, a speech delivery portion 13 incorporating a microphone, etc. Provided in a suitable portion of the interior of the case 11 is a notifying unit 2 for notifying the user of incoming calls with sound, vibration or both sound and vibration.

Figure 2:
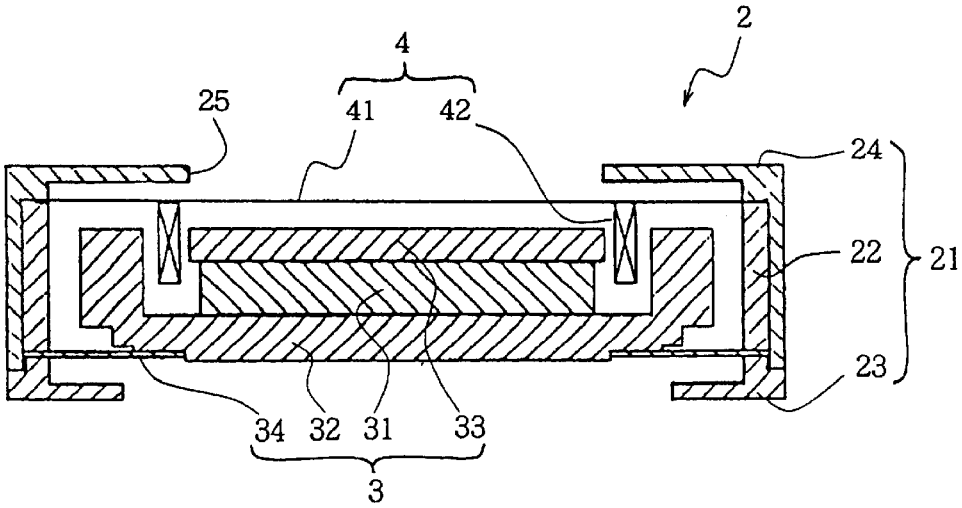
FIG. 2 (PRIOR ART)
FIG. 2 is an enlarged view in section of a notifying unit.

As shown in FIG. 2, the notifying unit 2 comprises as housed in a common casing 21 a first vibrator 4 for producing sound mainly and a second vibrator 3 for producing vibration mainly. The casing 21 comprises a hollow cylindrical body 22, an annular front cover member 24 having a sound release aperture 25 and attached to an open front side of the body 22, and an annular rear cover member 23 attached to an open rear side of the body 22.

The first vibrator 4 comprises a circular first diaphragm 41 having its peripheral portion held between the casing body 22 and the front cover member 24, and a coil 42 fixed to the rear side of the first diaphragm 41. The first vibrator 4 has a resonance frequency in the audible range.

On the other hand, the second vibrator 3 comprises an annular second diaphragm 34 having its peripheral portion held between the casing body 22 and the rear cover member 23, an outer yoke 32 secured to the inner peripheral portion of the second diaphragm 34, a permanent magnet 31 magnetized axially thereof (upward or downward direction) and fixed to the front side of the outer yoke 32, and an inner yoke 33 fixed to the front side of the magnet 31. The coil 42 of the first vibrator 4 is accommodated upwardly or downwardly movably in an annular magnetic gap defined by opposed faces of the outer yoke 32 and the inner yoke 33. The second vibrator 3 has a low resonance frequency (e.g., about 50 Hz to about 300 Hz) actually inaudible.

The first and second diaphragms 41, 34 can be made from a known elastic material such as metal, rubber or resin. When required, the second diaphragm 34 has cuts or notches so as to obtain a great displacement.

Figure 1:
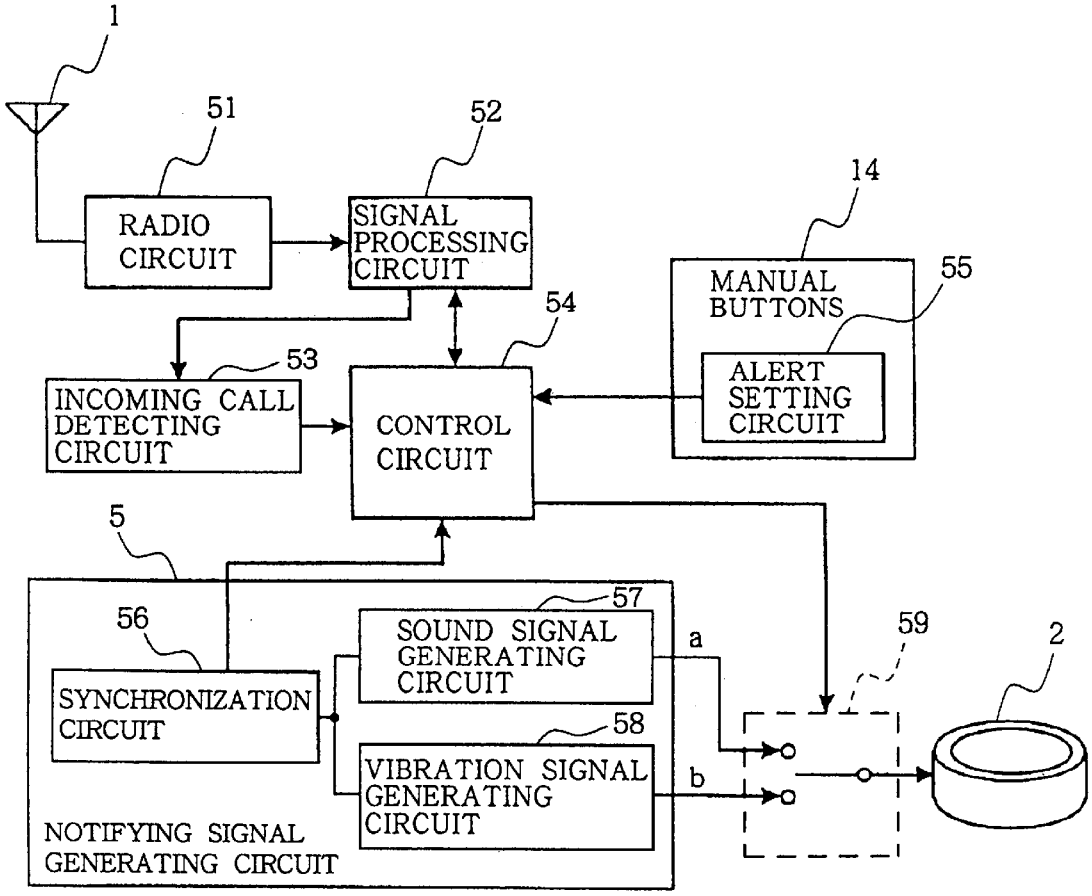
FIG. 1 is a block diagram showing the circuit construction of a notifying device embodying the invention.

FIG. 1 shows the construction of the main circuit of the portable telephone having the notifying unit 2 described. The telephone is so adapted that when pressed, the manual button 14 enables the user to select notification with sound, notification with vibration or notification by the simultaneous operation of both the sound and vibration means for alerting the user to incoming calls. In conformity with the selection thus made, an alert setting circuit 55 sets the selected alerting method for a control circuit 54.

A notifying signal generating circuit 5 is connected to the notifying unit 2 by way of a switch 59, which is changed over under the control of the control circuit 54.

Radio waves transmitted by the base station are received by the antenna 1 at all times with a specified period. The signal received is frequency-converted and demodulated by a radio circuit 51 and then fed to a signal processing circuit 52, which extracts a digital sound signal and a control signal from the signal. The operation of the signal processing circuit 52 is controlled by the control circuit 54.

The control signal obtained by the signal processing circuit 52 is fed to an incoming call detecting circuit 53, whereby an incoming call is detected if any. On the other hand, the sound signal given by the circuit 52 is fed to an unillustrated sound signal processing circuit and then output from a speaker as sound.

The notifying signal generating circuit 5 comprises a sound signal generating circuit 57 for producing a sound drive signal a of audio-frequency for notification with sound, a vibration signal generating circuit 58 for producing a vibration drive signal b of actually inaudible low frequency for notification with vibration, and a synchronization circuit 56 for feeding a common synchronizing signal to the two circuits 57, 58.

Figure 4:
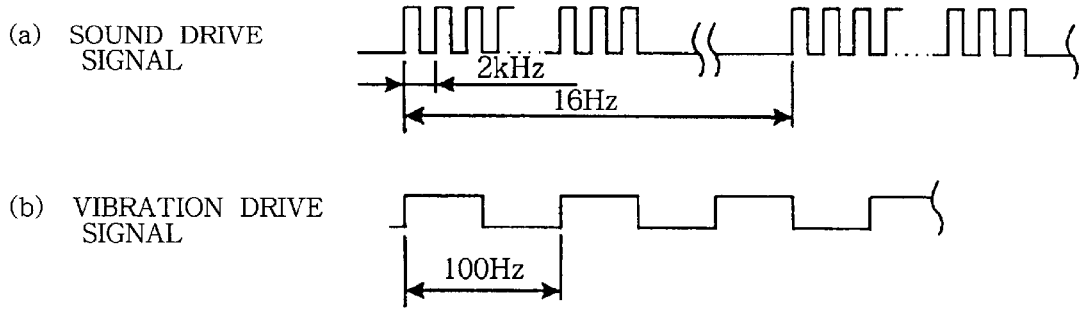
FIGS. 4, (*a*) and (*b*) are waveform diagrams of a sound drive signal and a vibration drive signal.
Figure 5:
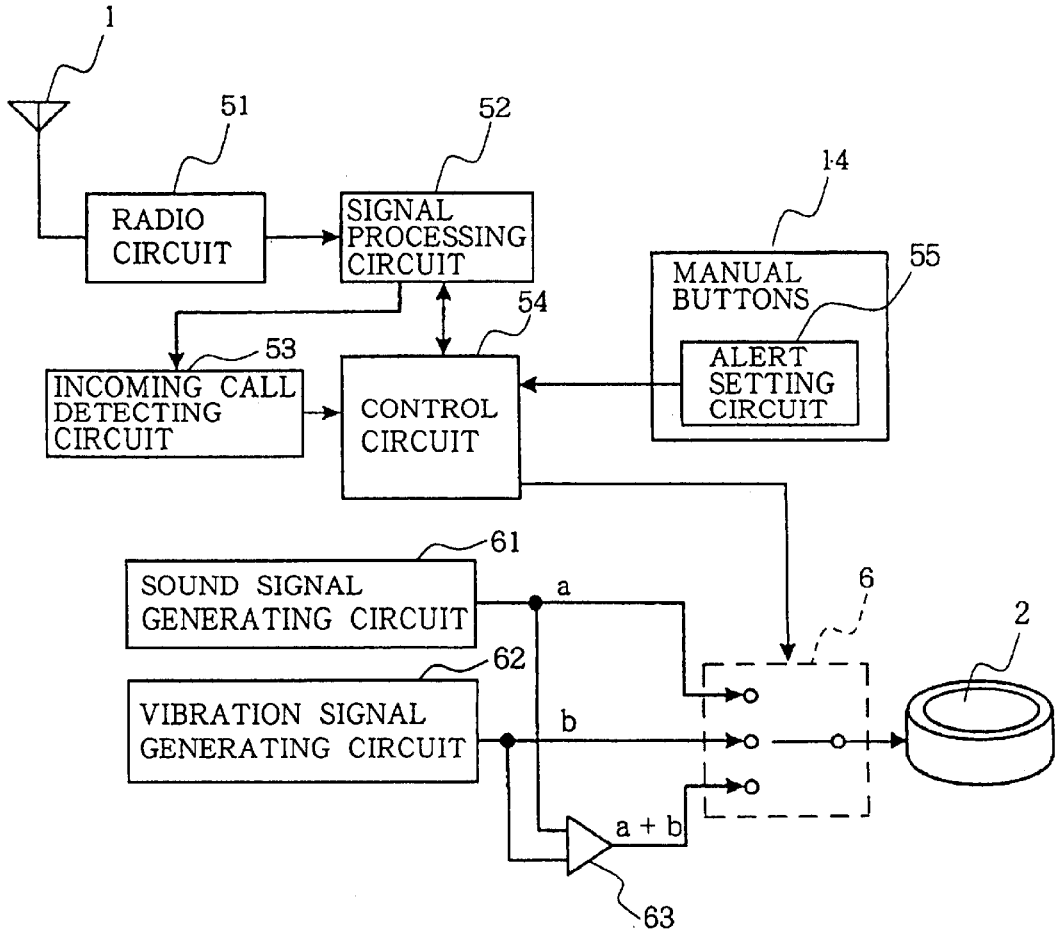
FIG. 5 (PRIOR ART)
FIG. 5 is a block diagram showing the circuit construction of a notifying device comprising a notifying unit proposed by the present applicant.
Figure 6:
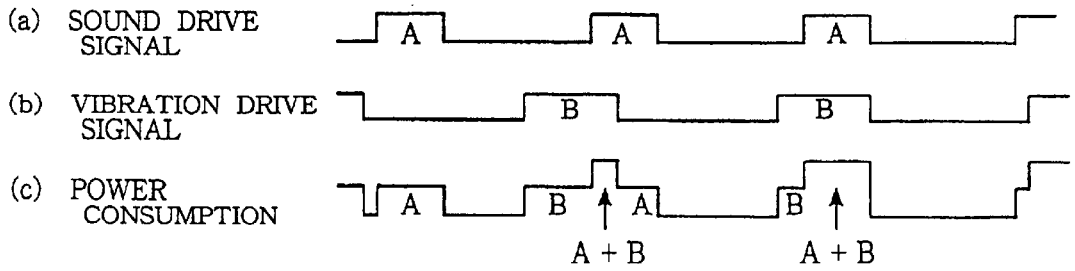
FIG. 6 (PRIOR ART)
FIGS. 6, (*a*) to (*c*) are time charts for illustrating a drawback of the circuit construction.

With reference to FIG. 4, (*a*), the sound drive signal a produced by the sound signal generating circuit 57 is prepared from pulses having an audio-frequency of 2 kHz by on/off-controlling at 16 Hz. The series of pulses formed provides a readily audible notifying sound which sounds like "purrr...." On the other hand, the vibration drive signal b produced by the vibration signal generating circuit 58 comprises pulses having a frequency (e.g., 50 Hz to 300 Hz, preferably about 100 Hz) easily perceivable by the human body as vibration as shown in FIG. 4, (*b*).

Figure 3:
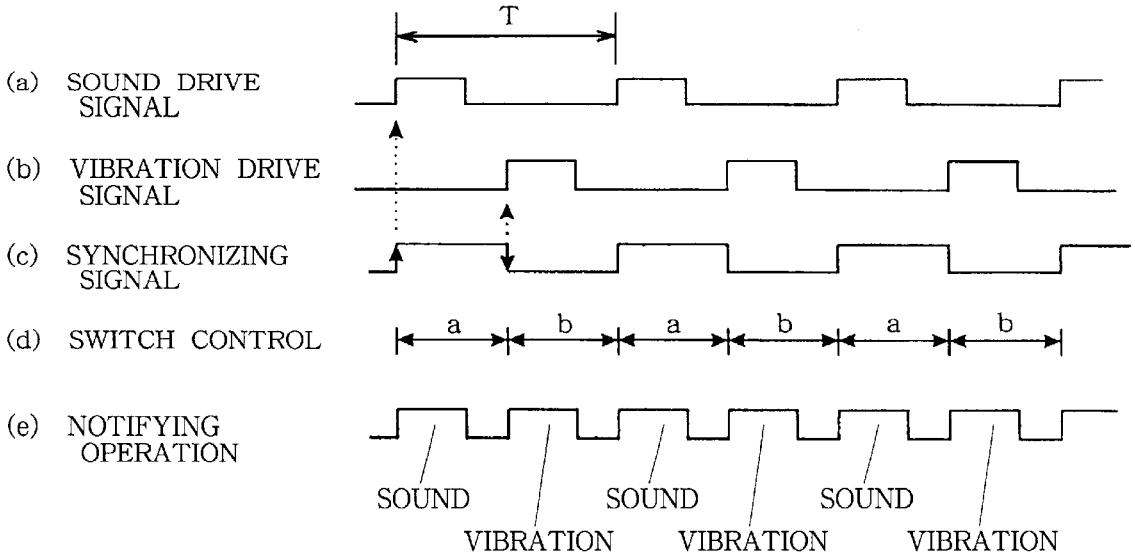
FIGS. 3, (*a*) to (*e*) are time charts for illustrating the operation of the notifying device of the invention.

Referring to FIG. 3, (*c*), the synchronization circuit 56 produces a synchronizing signal having a period T of about 3 seconds. As shown in FIG. 3, (*a*), the leading edge of the synchronizing signal brings the sound drive signal a to an on state, followed by an off state upon lapse of a predetermined period. Further the trailing edge of the synchronizing signal brings the vibration drive signal b to an on state, followed by an off state a predetermined period of time thereafter as seen in FIG. 3, (*b*). There is no overlap between the on period of the sound drive signal and the on period of the vibration drive signal.

The sound drive signal a and the vibration drive signal b thus on/off-controlled are fed respectively to two input terminals of the switch 59 of FIG. 1.

In response to a change-over control signal from the control circuit 54, the switch 59 is closed alternately at the two input terminals with the period of T as shown in FIG. 3, (*d*), selecting the sound drive signal a during the on period thereof and the vibration drive signal b during the on period thereof to prepare a combined drive signal, which is fed to the notifying unit 2.

When an incoming call is detected by the detecting circuit 53, the control circuit 54 changes over the switch 59 in conformity with the alert setting by the manual button 14.

When the user is to be notified of the incoming call with sound only, the switch 59 is changed over for connection to the sound signal generating circuit 57 to feed the sound drive signal alone to the notifying unit 2.

This causes alternating current to flow through the coil 42 of the notifying unit 2 for the coil 42 to produce an axial drive force by virtue of the relationship between the magnetic lines of force extending through the magnetic gap radially thereof and the circumferential current flowing through the coil 42 according to the Fleming's left-hand rule. Since the drive force acts at the frequency of the resonance point, the first vibrator 4 resonates to generate sound waves, while the second vibrator 3 remains almost free of vibration because the resonance point thereof is different.

When notification is to be given only with vibration, the switch 59 is changed over for the vibration signal generating circuit 58 to feed the vibration drive signal alone to the notifying unit 2.

This similarly causes the coil 42 to produce an axial drive force. Since the resonance point of the first vibrator 4 differs from the frequency of the drive force, the first vibrator 4 undergoes almost no vibration, but the second vibrator 3 which has a resonance point at the frequency of the drive force is resonated by the reaction of the drive force to produce vibration.

When notification is to be given with both sound and vibration, the switch 59 is changed over with the predetermined period T alternately at the terminals for the sound signal producing circuit 57 and the vibration signal generating circuit 58 as previously described, and the resulting combined drive signal is fed to the notifying unit 2.

Accordingly, the first vibrator 4 of the unit 2 resonates to produce sound mainly during the on period of the sound drive signal contained in the combined drive signal, and the second vibrator 3 of the unit 2 resonates to produce vibration mainly during the on period of the vibration drive signal contained in the combined drive signal.

As a result, sound and vibration are alternately produced in repetition with the period T for notification as shown in FIG. 3, (*e*).

The notifying device of the present invention is free of the likelihood that the on period of the sound drive signal for driving the first vibrator 4 and the on period of the vibration drive signal for driving the second vibrator 3 will lap over each other. This obviates marked increases in power consumption, and the operation to give notification with sound and vibration is unlikely to cause trouble to other operation of the device.

The device of the present invention is not limited to the foregoing embodiment but can be modified variously within the technical scope defined in the appended claims. For example, the present invention is not limited only to the notifying unit 2 shown in FIG. 2 and having the functions of a sound generator and a vibration generator but can be embodied as a notifying device comprising a sound generator and a vibration generator which are separate units. In this case, the sound drive signal and the vibration drive signal are fed individually to the sound generator and the vibration generator with their on periods out of phase.

The sound generator of the notifying unit 2 is useful not only as a ringer for notifying the user of incoming calls but also as a speaker for receiving speech.

What is claimed is:

1. A notifying device which comprises a first vibrator drivable at an audio-frequency with a first drive signal for producing sound waves, a second vibrator drivable with a second drive signal at a frequency lower than the driving frequency of the first vibrator for producing a perceivable vibration, and a signal generator circuit for producing the first drive signal and the second drive signal, the notifying device being characterized in that the signal generator circuit comprises a first drive signal generating circuit for producing the first drive signal, a second drive signal generating circuit for producing the second drive signal, and timing control means for feeding a timing control signal, and timing control means for feeding a timing control signal to the first drive signal generating circuit and the second drive signal generating circuit so as to output the first drive signal and the second drive signal at times different from each other.

2. A notifying device according to claim 1 wherein the timing control means produces as the timing control signal a synchronizing signal having a leading edge and a trailing edge alternately, the first drive signal generating circuit being operable to bring the first drive signal to an on state at one of the edges of the synchronizing signal, the second drive signal generating circuit being operable to bring the second drive signal to an on state at the other edge of the synchronizing signal, the first drive signal generating circuit being operable to bring the first drive signal to an off state upon lapse of a predetermined period of time shorter than the time difference after turning on the first drive signal, the second drive signal generating circuit being operable to bring the second drive signal to an off state upon lapse of a predetermined period of time shorter than the time difference after turning on the second drive signal.

3. A notifying device according to claim 1 wherein the first vibrator and the second vibrator are housed in a common casing, the first vibrator comprising a coil attached by a first diaphragm to the casing, the second vibrator comprising a magnet attached by a second diaphragm to the casing, the magnet being formed with a magnetic gap having the coil of the first vibrator accommodated therein.

4. A notifying device according to claim 3 wherein the signal generator circuit prepares a combined drive signal comprising the first drive signal and the second drive signal superposed thereon with no overlap between their on periods and feeds the combined drive signal to the coil.

5. A notifying device according to claim 4, wherein the signal generator circuit comprises a signal selecting means for preparing the combined control signal by alternately selecting the first drive signal and the second drive signal.

* * * * *